United States Patent [19]

Buckwalter et al.

[11] 4,181,497

[45] Jan. 1, 1980

[54] PROCESS FOR SHADING DURING THE VAPOR PHASE DYEING OF CARPET

[75] Inventors: Mervin R. Buckwalter; Walter T. Bulson; Leonard N. Ray, Jr., all of Lancaster, Pa.

[73] Assignee: Armstrong Cork Company, Lancaster, Pa.

[21] Appl. No.: 694,763

[22] Filed: Jun. 10, 1976

[51] Int. Cl.[2] ..... D06P 5/20; D06P 7/00

[52] U.S. Cl. ..... 8/2.5 A; 8/1 XB; 8/2.5 R; 101/470

[58] Field of Search ..... 8/2.5 R, 2.5 A; 101/470

[56] References Cited

U.S. PATENT DOCUMENTS

| | | | |
|---|---|---|---|
| 3,649,332 | 3/1972 | Dybvig | 117/38 |
| 3,782,896 | 1/1974 | Defago et al. | 8/2.5 |
| 3,949,574 | 4/1976 | Glover | 68/5 C |

FOREIGN PATENT DOCUMENTS

| | | | |
|---|---|---|---|
| 1380724 | 1/1975 | United Kingdom | 8/2.5 A UX |

*Primary Examiner*—Stanford M. Levin

[57] ABSTRACT

A process is disclosed for the making of a decorative carpet through the use of sublimable dyes. A shading effect is secured through the use of air flow control sheets that affect the flow of air through a transfer sheet and a carpet product adjacent thereto. By lessening air flow, the intensity of dye being transferred is also lessened so that shades of a certain color can be secured.

1 Claim, 2 Drawing Figures

PROCESS FOR SHADING DURING THE VAPOR PHASE DYEING OF CARPET

BACKGROUND OF THE INVENTION

1. Field of the Invention

The invention is directed to a process for making carpet and, more particularly, to a process for using sublimable dyes to provide a design to a carpet.

2. Description of the Prior Art

The use of sublimable dyes for dyeing carpet is old in the art. In U.S. Pat. No. 3,860,388, there is taught the use of a sheet between the product being dyed and the transfer sheet. The sheet in question is used to eliminate the problem of sticking of the transfer sheet to the material being printed.

It is believed that the prior art lacks the teaching of using an air flow to carry out the transfer of the sublimable dyes from the transfer sheet to a carpet. Further, it is submitted that the prior art lacks the use of a shading means which limits air flow in certain areas so that dye intensity is diminished in those areas.

SUMMARY OF THE INVENTION

The invention is a process for making a decorative carpet through the use of sublimable dyes. The sublimable dyes are placed on a porous transfer sheet. The porous transfer sheet is then placed adjacent the face fiber yarns of a carpet. A shade control means is then positioned relative the transfer sheet and the carpet product. The shade control means could be a porous member which is placed adjacent the transfer sheet. It may be placed between the transfer sheet and the carpet, or it may be placed on the side of the transfer sheet away from the carpet. This shade controlling sheet is porous and its porosity is so controlled so that it limits the amount of air passing through the shade control means, the transfer sheet, and the carpet. By limiting the air flow, the rate of dye transfer is reduced and consequently, the intensity of the color placed on the carpet is lessened. The shade control means could also be a non-porous sheet which is placed on the back side of the carpet. This then affects the air flow through the transfer sheet and the carpet and again results in a lessening of the intensity of the dye being deposited on the carpeting. The dye transfer process requires the use of air to move the dye from the transfer sheet to the carpet. In selected areas of the carpet, the shade control means lessens the air flow and consequently, the dye transfer yielding a reduced dye intensity at the points where the shade control means exist. This then provides a difference in shade of color between those areas where the shade control means exist and those areas where the shade control means does not exist with respect to a certain color being transferred.

DESCRIPTION OF THE PREFERRED EMBODIMENTS

Figure 1:
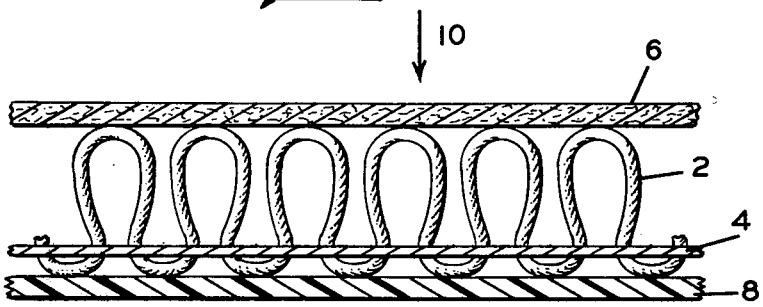
FIG. 1 is a cross-sectional view of a carpet structure with a shade control means positioned on the back side of the carpet.

Referring now to FIG. 1, there is shown a conventional tufted carpet which has face fiber yarns 2 fastened to a conventional backing 4. A dye transfer sheet containing sublimable dyes deposited thereon in a desired pattern is placed adjacent the ends of the face fiber yarns 2. A non-porous sheet 8, a shade controlling means, is positioned adjacent the back of the carpet structure adjacent the backing 4. With air flow in the direction of the arrow 10, the heat of the air will convert the dye on the transfer sheet 6 from a solid to a vapor phase. The air then carries the dye to the face fiber yarns 2. The shade controlling means 8 tends to lessen the flow of the air through the transfer sheet and the carpet structure since it functions as a barrier to the air flow and forces the air to move laterally of the carpet structure rather than directly through the carpet structure. This lessening of the air flow diminishes the amount of dye which is moved from the transfer sheet 6 to the face fiber yarns 2 over the amount of dye that would be moved by the air flow from the transfer sheet 6 to the face fiber yarns 2 if sheet 8 were not in position relative the carpet. The reduced dye transfer, due to the presence of sheet 8, over the amount of dye transfer secured without the sheet 8 results in a transfer of some dye, but a reduction in the concentration of the dye, and consequently a shade difference between those areas where sheet 8 exists and doesn't exist.

Figure 2:
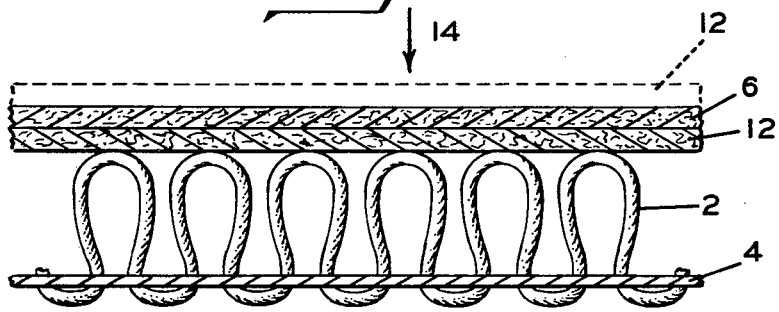
FIG. 2 is a cross-sectional view of a carpet structure with the shade control means positioned adjacent the dye transfer sheet.

Referring now to FIG. 2, there is again provided a conventional carpet with face fiber yarns 2 and a backing 4. A transfer sheet 6 is likewise utilized. A shade controlling means 12 is then positioned either between sheet 6 and face fiber yarns 2 or on the back side of sheet 6 away from the side of sheet 6 engaging the face fiber yarns 2. The sheet 12, which functions as a shade controlling means, is a porous sheet. Air moves in the direction of arrow 14 to cause the transfer of the sublimable dyes from sheet 6 to the face fiber yarns 2. The existence of the porous sheet 12 lessens the air flow and thus the intensity of the dye being transferred. Consequently, the same effect is secured with the structure of FIG. 2 as with the structure of FIG. 1. That is, less dye is transferred where the shade controlling means is utilized and, therefore, the shade difference is secured in those areas where a shade controlling means is utilized versus those areas where no shade controlling means is utilized.

A series of examples were carried out to determine the shading characteristics obtainable when various porous barrier sheets are located either between the transfer sheet and the carpet or on the side of the transfer sheet opposite from the side of the transfer sheet engaging the carpet face fiber yarns. Eight porous shade controlling means in the form of sheets were formed to provide both a range of porosity and a selection of different materials. The materials utilized are as follows:

| Shade Controlling Means | Permeability (Standard cubic feet per minute per square foot-SCFM/ft.$^2$ per ASTM D-737-46) | |
|---|---|---|
| | One Thickness | Two Thicknesses |
| Reemay 2014 (Polyester) | 859 | 500 |
| Reemay 2033 (Polyester) | 240 | 140 |
| Glass Paper (E-35-S61-58) | 208 | 113 |
| Haines 186F | 32 | 19 |

-continued

| Shade Controlling Means | Permeability (Standard cubic feet per minute per square foot-SCFM/ft.$^2$ per ASTM D-737-46) One Thickness | Two Thicknesses |
|---|---|---|
| (Cellulose) | | |

A transfer sheet is provided with a sublimable dye. The transfer sheet is glass paper having a porosity of 208 SCFM/ft.$^2$. The sublimable dye used is a standard sublimable dye, for example, a 15% solution of latyl cerise dye in water. The particular dye utilized is CI Constitution No. 60756. It is deposited on the transfer sheet by a conventional rotogravure printer having 120 lines per inch. A carpet structure is then provided formed with a backing of jute material having a 19 by 19 count. On the backing material there is tufted a Nylon 66 yarn to a pile height of 5/16 inches to provide a carpet face weight of 13 ounces per square yard. The yarn is tufted into the backing at the rate of 12 tufts per inch.

Between the above-described transfer sheet and carpet structure there is inserted one example of each of the above-identified shade controlling means. Air at 425° F. and 15 standard cubic feet per minute per square foot is then passed through this multi-layer structure for one minute.

A second set of shade controlling means, one each of the above-identified shade controlling means, is positioned on the side of the transfer sheet away from the side of the transfer sheet engaging the face fiber yarns of the carpet structure. Air is now passed through the shade controlling means, the transfer sheet, and the carpet in this respective order at a temperature of 425° F. and 15 standard cubic feet per minute per square foot. In both above examples, certain portions of the transfer sheet and carpet structure contain no shade controlling means and other portions contain shade controlling means.

As a result of carrying out the above examples, it was noted that shading effects begin to show at a porosity of 859 SCFM/ft.$^2$ when the shade controlling means is placed between the transfer sheet and the carpet. The shading becomes lighter as the porosity of the shade controlling means is reduced, and at a porosity of 140 SCFM/ft.$^2$, the carpet area where a shade controlling means exists is not colored by any of the sublimable dyes from the transfer sheet. In those areas where dye is transferred, dye does travel and cover the full length of the carpet face fibers. The shading effect is measured visibly with reference to those areas of the transfer sheet-carpet construction that has no shade controlling means and is subject to the same air flow conditions, and thus yields the dye transfer of a certain intensity which is considered to be the control intensity.

Shading effects begin to show at a porosity of 208 SCFM/ft.$_2$ when the shade controlling means is placed in front of the transfer sheet. That is, on the side of the transfer sheet away from the side of the transfer sheet contacting the face fiber yarns. The shading becomes lighter as the porosity of the shade controlling means is reduced, and at a porosity of 32 SCFM/ft.$^2$, the carpet area adjacent the shade controlling means is not colored by the dye. Again, where there was dye transferred there is evidence of the transfer of the dye over the full length of the carpet fibers, and the shading is measured visibly relative to portions of the carpet dyed without the presence of a shade controlling means.

The materials used to form the shade controlling means may have a slight influence on the final result. The Reemay material (polyester material) absorbs more dye than the glass paper. However, the porosity of the barrier sheet is the factor that has the greatest significant effects on the final results.

The final experiment carried out involved the use of a non-porous barrier sheet being placed on the back of the carpet structure. This would be adjacent the backing of the carpet, as shown in FIG. 1. Air at 425° F. is then directed at the transfer sheet on the face fiber yarns of the carpet. The air flow towards the transfer sheet is 15 standard cubic feet per minute per square foot. Obviously, the non-porous barrier sheet, which is functioning as a shade controlling means, prevents air from passing directly through the transfer sheet and carpet structure. Utilizing the above technique, the carpet fibers are not dyed to their full depth, but are only dyed on their ends adjacent the dye transfer sheet. This would seem to indicate that there is only a direct surface transfer. It was found that the non-porous barrier sheet, or shade controlling means, must have a minimum width of $\frac{7}{8}$ inch in order to achieve any noticeable shading effects. With the use of the non-porous barrier strip, there is clearly a difference in shade in those areas where the barrier strip exists versus those areas where a barrier strip does not exist and the air may pass directly through the transfer sheet and carpet. As was indicated above, a further noticeable difference between the areas utilizing the barrier strip and the areas not utilizing the barrier strip is that those areas with the barrier strip have only the dyeing of the upper ends of the carpet structure adjacent the transfer sheet, while those areas not utilizing the barrier sheet have a dyeing of the complete carpet yarn structure. The barrier sheet may be any type of material which will prevent air flow and not be deteriorated by the heat involved. A particularly good material to use as a barrier sheet is metal foil.

The shade controlling means may have uniform porosity or non-porous porosity. It is also possible for the shade controlling means to have areas of different porosities in the form of a pattern. In still another form, the shade controlling means may have an interrupted pattern.

What is claimed is:

1. A process for making a decorative carpet through the use of sublimable dyes comprising the steps of:

(a) printing sublimable dyes on a porous transfer sheet, (b) preparing a carpet product which has on one side thereof carpet yarn forming the face fiber yarns, (c) placing the transfer sheet adjacent the face fiber yarns so that the transfer sheet with the sublimable dyes printed thereon will be adjacent the face fiber yarns of the carpet product, (d) positioning a shade controlling means in the form of a non-porous sheet relative the back side of the carpet product to reduce the air flow permeability through the transfer sheet and carpet product so as to yield a reduction of dye intensity in those areas where the shade controlling means exists, said shade controlling means having a minimum width of $\frac{7}{8}$ inch, and (e) transferring the sublimable dyes from the transfer sheet to the carpet face yarns by the application of a directional flow, heated gaseous medium, passing through the transfer sheet and the carpet product in the direction from the transfer sheet towards the face fiber yarns with the areas not containing the shade controlling means resulting in full color transfer of dye from the transfer sheet to the face fiber yarns of the carpet product and with those areas containing the shade controlling means there being a reduction in the dye intensity on the face fiber yarns of the carpet product.

* * * * *